United States Patent [19]

Badders

[11] Patent Number: 4,672,991

[45] Date of Patent: Jun. 16, 1987

[54] BACK FLOW PREVENTION VALVE

[76] Inventor: Edwin T. Badders, 3040 Riverside Drive Ter., Chino, Calif. 91710

[21] Appl. No.: 846,949

[22] Filed: Apr. 1, 1986

[51] Int. Cl.[4] ..... F16K 24/02

[52] U.S. Cl. ..... 137/218

[58] Field of Search ..... 137/102, 107, 218

[56] References Cited

U.S. PATENT DOCUMENTS 3,905,382 9/1975 Waterson ..... 137/218 X 4,518,006 5/1985 Hoffmann ..... 137/218

*Primary Examiner*—Robert G. Nilson

*Attorney, Agent, or Firm*—Lyon & Lyon

[57] ABSTRACT

An in line pressure sensitive back flow prevention valve assembly adaptable for high volume flow applications comprising an elongated housing having a fluid inlet and outlet at opposite ends thereof, an axial control rod reciprocally mounted therein, a valve motor piston carried by one end of the rod in sliding engagement with the housing inwardly spaced from the fluid inlet and an elongated double poppet valve slidably mounted within the housing on the control rod and defining with a second slidably mounted piston, an upstream check valve and, with a slidably mounted sleeve, a downstream check valve. Biasing spring urge the motor piston toward the fluid inlet and the check valves to the closed position. The valve elements are sized to utilize the fluid forces acting thereon to open the valve assembly in response to slight decreases in downstream pressure and to cooperate with the biasing springs to close the valve assembly in response to significant increases in downstream pressure. A zone of substantially reduced pressure is provided within the housing about the double poppet valve between the check valves when the valve assembly is in the closed position to prevent back flow through the valve. A channel in the housing communicates with the reduced pressure zone for venting the zone to atmosphere in response to decreases in line pressure to maintain a reduced pressure within the zone when the valve assembly is in the closed position.

16 Claims, 3 Drawing Figures

BACK FLOW PREVENTION VALVE

BACKGROUND OF THE INVENTION

To prevent contamination of potable water supplies from downstream contaminants, back flow prevention valves are commonly employed in the water line and are generally required by applicable law. Such valves are typically installed in water lines downstream of the water meter and act to prevent fluid flow back through the valve which would otherwise occur if the downstream pressure exceeded the upstream pressure. While the back flow prevention valves currently in use generally accomplish their intended purpose, they have been found to have several inherent shortcomings. Such valves typically employ diaphragms which are subject to wear and bursting at high pressure. The currently available devices also generally employ circuitous flow passageways which cause excessive pressure drops rendering these valves poorly suited for high volume flow. The solution to this problem has been to oversize the valves which necessarily increases the cost of construction. The problem of excessive pressure drop is aggravated by the insensitivity of these valves, resulting in a slow opening response which typically occurs only when a 30 to 40 psi pressure differential is created across the valve. The light spring loads and flat seals employed in these devices also inhibit high volume flow and require a large head force to open the valve fully which, in combination with the rapid closing found in such valves, creates undesirable water hammering.

In addition to the above, the back flow prevention valves currently in use uniformly have inadequate reduced pressure zones across the valves which are necessary to maintain a downstream pressure within the valve which is below the upstream pressure to prevent upstream siphoning and resulting contamination. This is a particularly acute problem in high hazard applications such as metal plating acid tanks and the like which present substantial hazards to potable water supplies. In addition to providing inadequate safeguards against upstream siphoning, the inadequate pressure drops in the reduced pressure zones of the prior art, which are typically about only 1 to 5 psi, create periodic unloading and loading of the valves in response to common fluctuations in line pressure. This further inhibits high volume flow and results in frequent undesirable water dumping or leakage. These problems are illustrative of the shortcomings found in the back flow prevention valve heretofore available.

In view of the above, it would be highly desirable to provide a compact, responsive and durable back flow prevention valve highly suitable for high hazard applications and one which is capable of handling both high and low volume flow with minimal restriction and pressure loss. It would also be highly desirable to provide a back flow prevention valve which maintains a substantially greater pressure drop in the reduced pressure zone than found in current valves to provide improved protection against upstream siphoning. Finally, it would be desirable to substantially eliminate the effect of line pressure fluctuations and reduce water hammering. Such a valve is disclosed and claimed herein.

SUMMARY OF THE INVENTION

Briefly, the invention comprises an in-line back flow prevention valve assembly for use in preventing contamination of an upstream fluid supply from downstream contaminants. The valve assembly comprises a double poppet valve which cooperates with a slidably mounted piston to form an upstream check valve and with a slidably mounted sleeve to form a downstream check valve. An upstream motor piston is movable under the force of upstream fluid under pressure to displace the double poppet valve and rapidly open the check valves formed thereby in response to slight drops in the downstream fluid pressure. The valve assembly is maintained in the fully open position by the fluid forces acting therein despite fluctuations in line pressure. A zone of substantially reduced pressure is provided about the double poppet valve when the valve assembly is in the closed position to break the link between the downstream and upstream ends of the valve and thereby prevent siphoning of fluid back through the valve. Biasing means are provided for cooperation with valve means in the motor piston and in the valve assembly and with hydraulic forces acting within the valve assembly to close the valve assembly in response to significant increases in downstream pressure to prevent the occurrence of back flow therethrough and eliminate the occurrence of water hammering. A channel is provided in the valve housing for use in venting the reduced pressure zone to atmospheric pressure in response to decreases in line pressure to maintain a reduced pressure within the reduced pressure zone at all times when the valve assembly is in the closed position.

It is therefore the principal object of the present invention to provide and improved back flow prevention valve for use in high volume flow applications.

It is another object of the present invention to provide a back flow prevention valve which provides improved protection against back siphoning, rendering the valve highly suitable for high hazard applications.

It is another object of the present invention to provide an improved back flow prevention valve which minimizes pressure loss of the fluid flow through the valve.

It is a further object of the present invention to provide a back flow prevention valve which is highly responsive to drops in downstream pressure to effect rapid opening thereof while being insensitive to fluctuations in line pressure to reduce the frequency of water-dumping and maintain high volume flow therethrough.

It is yet another object of the present invention to provide a back flow prevention valve which continually maintains a zone of substantial reduced pressure across the valve when the valve is in the closed position to prevent upstream fluid siphoning therethrough.

It is still a further object of the present invention to provide a back flow prevention valve which reduces the occurrence of water hammering upon closing of the valve.

It is yet another object of the present invention to provide a compact back flow prevention valve which is of durable and economical construction.

These and other objects of the present invention will become apparent from the following detailed description taken in conjunction with the accompanying drawings.

IN THE DRAWINGS

DESCRIPTION OF THE PREFERRED EMBODIMENT

Figure 1:
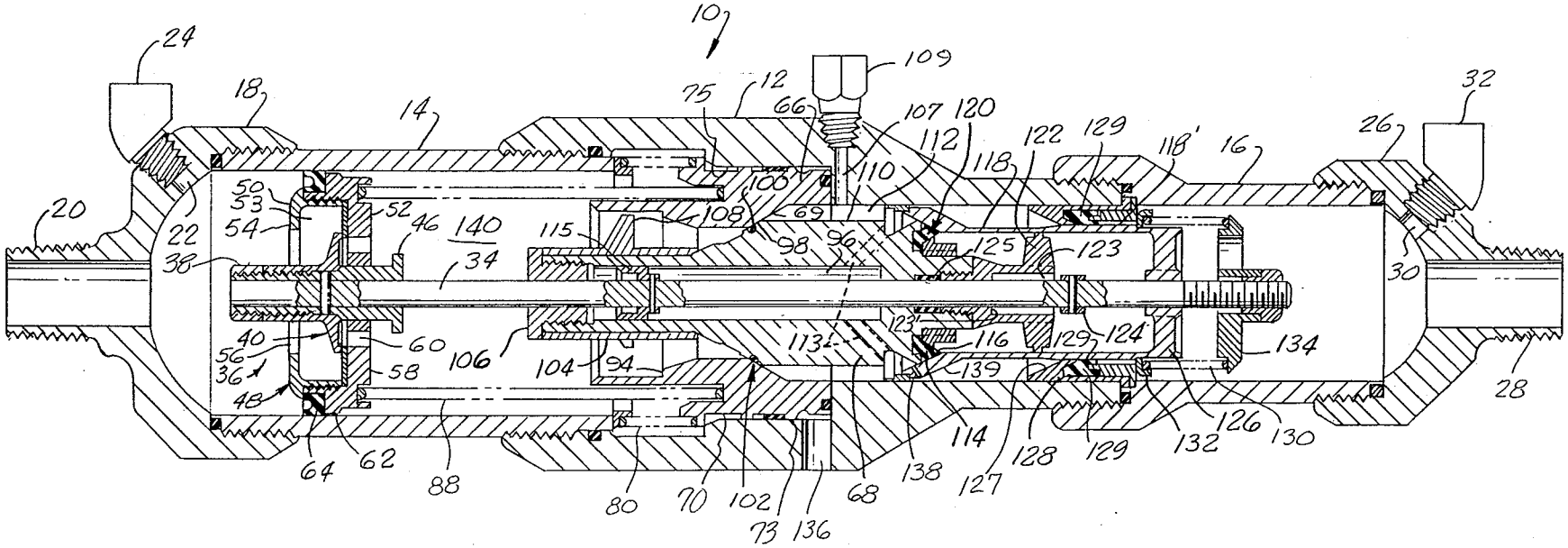
FIG. 1 is a cross-sectional view of the valve assembly of the present invention in the closed position.

The back flow prevention valve assembly 10 of the present invention comprises a valve body or housing 12 threadably engaged and in axial alignment with a cylindrical inlet tube 14 at the upstream end thereof and a cylindrical outlet tube 16 at the downstream end thereof. The inlet tube 14 defines and is referred to hereinafter as a motor piston cylinder. An inlet cap 18 is threadably secured to the upstream end of the motor piston cylinder 14 and defines an axially disposed fluid inlet 20 and a stepped aperture 22 adapted to receive a pressure tap 24. Similarly, an outlet cap 26 is threadably secured to the downstream end of the outlet tube 16 and defines an axially disposed fluid outlet 28 and a stepped aperture 30 adapted to receive a downstream pressure tap 32. In the preferred embodiment of the invention, the aforesaid elements are constructed of brass, although other suitable material could be used.

Figure 3:
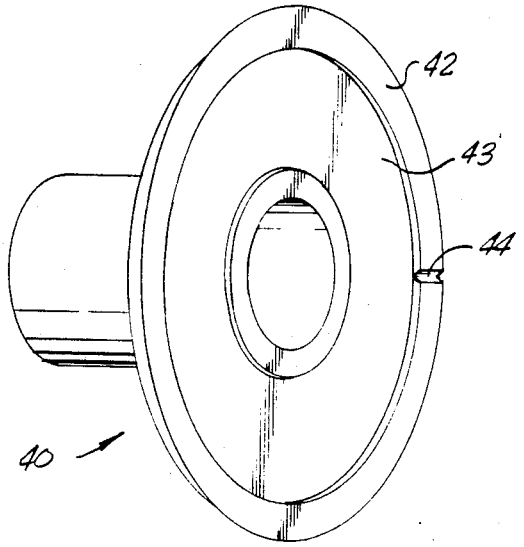
FIG. 3 is a perspective view of the sealing member on the value head within the motor piston.

A motor piston control rod 34, preferably constructed of stainless steel, is axially aligned within the valve housing 12, motor piston cylinder 14 and outlet tube 16. A valve head 36, preferably constructed of brass, is affixed to the upstream end of control rod 34. Valve head 36 comprises a central stem portion 38 disposed about and secured to the control rod 34, an annular sealing member 40 projecting radially from stem 38 intermediate the ends thereof and a radial end flange 46 defined by the downstream end of stem 38. As seen in FIG. 3, sealing member 40 defines a flat downstream surface 42 having an annular relief area 43 therein and a radially disposed slot 44 extending through that portion of surface 42 disposed about relief area 43 and communicating with the relief area. The slot 44 is preferably "V"-shaped and is about 0.012 inches wide at its outer edge.

The motor piston 48 which is preferably constructed of a plastic material, is slidably mounted on valve head 36 within the motor piston cylinder 14 and is comprised of a generally "U"-shaped mating caps 50 and 52 which are secured together in threaded engagement so as to define a chamber 53 therebetween. Caps 50 and 52 also define the upstream surface 54 of the motor piston 48 which has a plurality of axially aligned slots 56 extending therethrough, the downstream surface 58 of the motor piston which similarly defines a plurality of axially aligned slots 60 extending therethrough and a cylindrical side wall 62 which carries an annular seal 64 so as to form a sliding seal for the motor piston 48 with the interior wall of the motor piston cylinder 14 as the motor piston undergoes reciprocal linear motion within the motor piston cylinder to prevent any fluid leakage about the motor piston 48.

The annular slots 60 extending through the downstream surface 58 of the motor piston are spaced from the stem 38 of the valve head 36 and sized in relation to the radial sealing member 40 such that when the sealing member is in abutment with the interior downstream surface 58 of the motor piston, slots 60 are sealed preventing fluid flow therethrough. The slot 44 in the sealing member 40 does allow limited flow through the motor piston to equalize the pressure on both sides of the motor piston to prevent binding thereof and allow the motor piston to move under forces acting thereon as will be described.

Axially disposed and slidably mounted within the valve housing 12 are an air gap slider piston 66 and a double poppet valve 68. The air gap slider piston 66, preferably constructed of a plastic material, defines an upstream facing annular tapered sealing surface 69 and an outer cylindrical wall 70. Outer wall 70 defines raised contact points 73 which limit frictional contact with the interior cylindrical wall 75 of the valve housing 12 and additionally carries a flat lip seal 72 for preventing fluid leakage between the outer wall 70 of piston 66 and the valve housing 12. An annular radial flange 74 projects from piston wall 70 which is adapted to abut an annular stop 76 defined by the interior wall 75 of the valve housing 12 to limit the downstream movement of the air gap slider piston 66 and to abut annular stop 78 in its rearwardmost upstream position thereby limiting the linear sliding movement of the air gap slider piston 66. In the present embodiment of the valve 10, this movement of the air gap slider piston is restricted to about ½ inch. A return spring 80 is disposed between the radial flange 74 on the air gap slider piston 66 and a retaining clip 81 secured to the forward edge of the motor piston cylinder 14 to urge the air gap slider piston 66 to its forward most downstream position where the radial flange 74 abuts stop 76 and the forward edge 82 of the slider piston abuts an inwardly directed radial wall 84 defined by the valve housing. In the preferred construction of the valve 10, return spring 80 in a coil spring having a spring rate of about two to three pounds. An O-ring seal 86 is carried by the forward edge 82 of the air gap slider piston to prevent leakage past said forward edge when the air gap slider piston is in the forward most position.

A second coil spring 88 having a spring rate of about nine pounds is disposed between the motor piston 48 and the air gap slider piston 66 to bias the air gap slider piston to its forward position and the motor piston to its rearward closed position. Coil spring 88 is held in place by disposing the upstream rearward thereof in a recessed area 90 in the downstream surface 58 of the motor piston 48 and the downstream end in a recessed area 92 open at its upstream end in the air gap slider piston 66.

The double poppet valve 68 is preferably constructed of a plastic material and is centrally mounted within the valve housing 12 on control rod 34 and defines a central axial chamber 96 disposed about control rod 34 and an annular tapered upstream sealing surface 98 which carries a sealing ring 100. Sealing ring 100 is adapted to abut the tapered sealing surface 69 on the air gap slider piston 66 and together therewith forms a first check valve 102. Disposed upstream of the tapered sealing surface 98 on the double poppet valve 68 is a tubular extension 104 which terminates in a guide plug 106 which in turn is slidably mounted on the control rod 34. A radially projecting stop 108 extends from extension 104 which is adapted to abut a stop 94 defined by the air gap slider piston 66 to limit the forward downstream movement of the double poppet valve 68. The central portion 110 of the double poppet valve has an outer diameter less than the internal diameter of the valve housing 12 so as to define an annular area 112 therebetween termed the reduced pressure zone. A channel 107 is provided in the valve housing to a pressure tap 109 for monitoring the fluid pressure within the reduced pressure zone 112. Channels 113 communicate the reduced pressure zone 112 with the axial chamber 96 in the double poppet valve 68. A reduced pressure zone piston 115 is affixed to the control rod 34 within chamber 96 in the double poppet valve.

The downstream portion of the double poppet valve 68 carries a lip seal 114 which is adapted to abut an inclined surface 116 at the upstream end of a slider sleeve 118 which is slidably mounted on control rod 34. Lip seal 114 and surface 116 define a second check valve 120. Double poppet valve 68 also carries a slotted guide member 122 at the downstream end thereof which rides within and against the slider sleeve 118 and is spaced from control rod 34. Guide member 122 and guide plug 106 guide the movement of the double poppet valve 68 within the valve housing 12 about and along the control rod 34. An annular control rod seal 125 is carried by the double poppet valve 68 between guide member 122 and axial chamber 96. The forward guide member 122 on the double poppet valve 68 defines a forward recessed area 123 adapted to receive a stop member 124 which is secured to the control rod 34 and limits the downstream movement of the double poppet valve with respect to the control rod.

The slider sleeve 118 is generally of a hollow cylindrical configuration with the downstream portion 118′ of the wall of sleeve 118 having an outer diameter approximately 0.020 inches greater than the diameter of the upstream portion of the sleeve. This slight reduction in diameter in the upstream portion of the cylindrical wall of the slider sleeve is provided to relieve the pressure on the slider sleeve just prior to the opening of the second check valve 120 and prevent the slider sleeve from locking up under the pressure of the hydraulic forces acting thereon. As seen in the drawings, the diameter of the downstream portion 118′ of the slider sleeve 118 is slightly larger than the effective diameter across check valve 102. When the valve assembly 10 is in the closed position, the hydraulic area forces thus tend to urge the slider sleeve rearwardly against the lip seal 114 thereby maintaining check valves 102 and 120 in the closed position. Slider sleeve 118 also includes a slotted guide 126 at the forward end thereof which is slidably disposed about the control rod 34 and with guide member 122 maintains the proper orientation of the slider sleeve on the control rod 34 and with respect to the double poppet valve 68. In the preferred construction, the slider sleeve 118 is constructed of brass, with guide plug 106 and guide member 122 being of a plastic construction. A bleed hole 138 is provided in the inclined surface 116 of the slider sleeve 118 to prevent binding of the slider sleeve due to pressure differentials on the upstream and downstream sides of inclined surface 116.

An annular slider sleeve stop member 128 having a tapered upstream abutment surface 127 is carried by the downstream end of the valve housing 12. The tapered surface 127 of stop member 128 abuts correspondingly tapered downstream facing surface 139 of the slider sleeve when the valve is in the open position shown in FIG. 2. An annular slider sleeve seal 129 is carried by stop member 128. Seal 129 is in sealing contact with the enlarged radius portion 118′ of the slider sleeve 118 when the valve assembly 10 is in the closed position as seen in FIG. 1. In the open position, seal 129 is spaced slightly from the slider sleeve 118 as seen in FIG. 1 due to the slightly reduced outer diameter of the upstream portion of the slider sleeve. In addition, the slider sleeve seal 129 prevents the bleed hole 138 in the tapered surface 116 of the slider sleeve 118 from venting the reduced pressure zone 112 when the valve assembly is in the closed position. A return coil spring 130 having a spring load rate of about nine pounds is disposed between an annular spring retainer 132 secured to the slider sleeve 118 and an annular retainer 134 which is affixed to the downstream end of the control rod 34.

In operation, the back flow prevention valve 10 is positioned in a fluid flow line upstream of a conventional shut-off tap such as a faucet (not shown). Fluid, generally water, is introduced under pressure to the valve inlet 20. When the valve 10 is in the open position, it directs the fluid flow therethrough and out the valve outlet 28 to the shut-off tap.

FIG. 1 illustrates the valve 10 in the closed position preventing any fluid flow therethrough. By way of example, if the upstream line pressure were 100 psi, the pressure in that portion of the valve downstream of the double poppet valve 68 would typically be about 94 to 96 psi and the pressure in the reduced pressure zone 112 would be about 60–75 psi. Upon opening the downstream shut-off tap, the downstream pressure in the valve assembly 10 would immediately go to atmospheric (0 psi). This reduction in downstream pressure causes the valve assembly 10 immediately to open and allow fluid flow therethrough.

Figure 2:
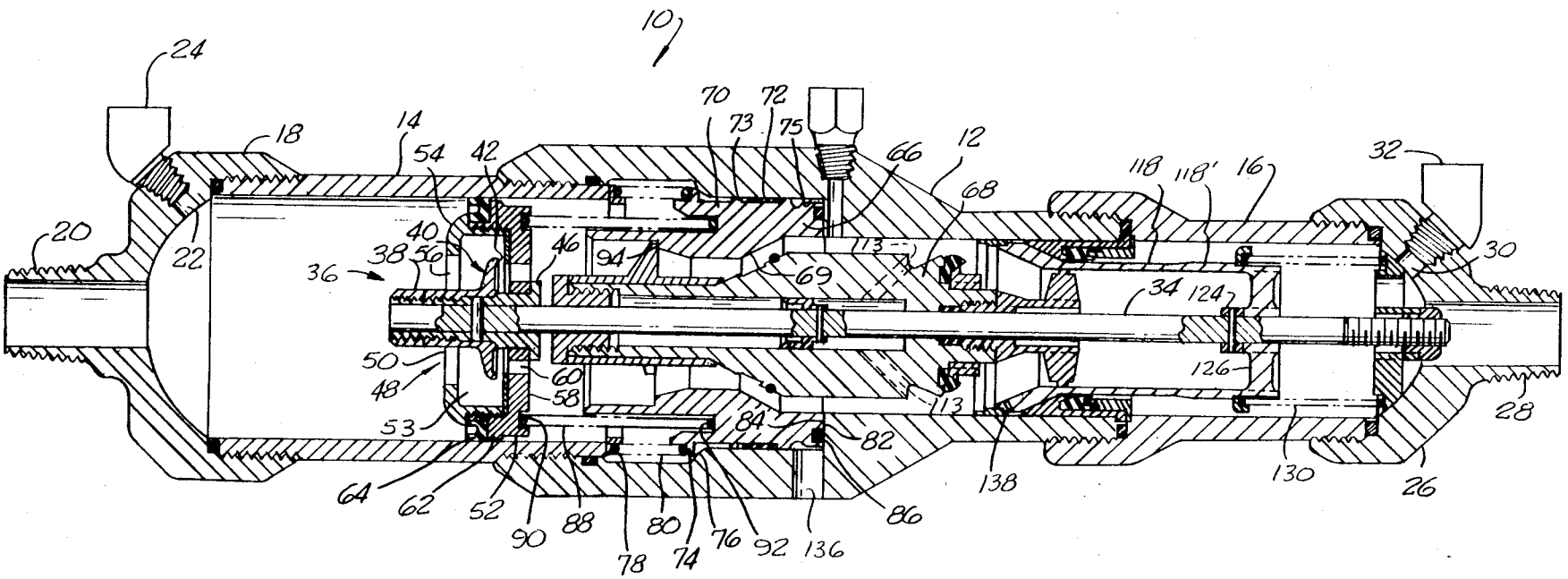
FIG. 2 is a cross-sectional view of the valve assembly of the present invention in the open position.

Upon opening of the shut off tap, the downstream pressure in the valve assembly immediately drops. The slider sleeve moves slightly downstream to the right due to the drop in hydraulic area forces acting on the larger diameter portion 118′ of the sleeve. As the slider sleeve moves to the right, check valve 120 is opened, equalizing the pressure in the reduced pressure zone 112. With the pressure exerted by the slider sleeve 118 on the double poppet valve 68 relieved and the upstream pressure in the valve exceeding the downstream pressure, the double poppet valve 68 floats off surface 69, opening check valve 102 and equalizing the pressure within the valve. The motor piston 48 under the force of the incoming water moves rapidly downstream with the motor piston valve head 36 and control rod 34 under the pressure of the incoming fluid, overcoming the force of coil spring 88. The reduced pressure zone piston 115 moves with the control rod 34 evacuating fluid from the central chamber 96 in the double poppet valve 68 through channels 113. The double poppet valve 68 moves forwardly until stop 108 thereon abuts annular stop 94 on the air gap slider piston 66. The forward movement of the slider sleeve 118 is limited by the abutment of the downstream tapered surface 139 of the slider sleeve with the correspondingly tapered upstream surface of the slider sleeve stop member 128 carried by housing 12 at the juncture of the housing with the valve outlet tube 16. Forward or downstream movement of the motor piston 48, valve head 36 and control rod 34 continues until the stop 124 affixed to the control rod abuts guide 126 as seen in FIG. 2, whereupon movement of control rod 34 and valve 36 terminates. The motor piston then continues forward until the radial flange 46 carried by the downstream end of the motor piston valve head 36 abuts the downstream surface 58 of the motor piston 48. When the motor piston moves forwardly with respect to the valve head 36, the axially aligned slots 60 in the downstream surface 42 of the motor piston 48 which are previously closed by the annular sealing member 40 on the valve head 36 are opened, allowing fluid flow therethrough. Water under pressure now passes from the fluid inlet 20, through the axial slots 56 and 60 in the upstream and downstream walls of the motor piston 48, through the first and second check valves 102 and 120, into the cylindrical outlet tubes through slotted guides 122 and 126 and out the fluid outlet 28. All of the above occurs extremely rapidly with the opening of the shut off tap.

Due to the slightly larger sizing of the larger diameter portion 118' of the slider sleeve than the upstream portion of the double poppet valve 68 across the first check valve 102, the fluid forces acting thereon cause the valve assembly 10 to begin to open in response to a downstream pressure drop of only about four psi.

In the open position, the pressure is equalized throughout the valve. The valve is maintained in the open position because of the hydraulic area forces operating on the upstream surface of the motor piston 48 which are greater than the combined forces of the coil spring 88 and the hydraulic area forces operating on the downstream surface of the double poppet valve 68 resulting from the larger surface area in the upstream portion of the motor piston as compared to the effective downstream area of the double poppet valve 68.

Upon the closing of the downstream tap, pressure immediately builds up in the downstream portion of the valve assembly 10 as flow therethrough ceases. Coil spring 88 first closes the motor piston 48 by urging the downstream surface 58 thereof against the radial sealing member 40 carried by valve head 36, sealing slots 60 and preventing fluid flow therethrough. As fluid vents through slot 44 in the radial sealing member 40 in valve head 36, the coil spring 88 slowly moves the motor piston 48 rearwardly pulling with it the control rod 34, double poppet valve 68 and reduced pressure zone piston 115. The double poppet it valve 68 rides on and with the control rod 34 until the sealing ring 100 at the upstream end thereof abuts sealing surface 69, closing check valve 102. Return spring 130 is compressed by the rearwrad movement of control rod 34 which causes the slider sleeve 118 to move rearwardly, closing check valve 120 while spring 88 continues to move the motor piston 48 upstream. The rearward movement of the reduced pressure zone piston 115 with control rod 34 increases the volume metric size of that portion of chamber 96 which communicates with the reduced pressure zone 112 through channels 113 thereby increasing the effective volume of the reduced pressure zone and reducing the pressure therein. With a head pressure of about 100 psi, the pressure in the reduced pressure zone would drop to about 70 psi. As the reduced pressure zone piston 115 moves rearwardly, the fluid behind the piston in chamber 96 is evacuated by piston 115 between the control rod 34 and the plug 106 at the upstream end of the double poppet valve where a standard sliding clearance is provided. The need for fluid to pass through the radial slot 44 in the sealing member 40 to allow the motor piston 48, control rod 34, double poppet valve 68 and reduced pressure zone piston 115 to move rearwardly provides a relatively slow closing cycle for the valve and eliminate water hammering.

While the rearward upstream movement of the motor piston is limited by the stop 124 secured to the control rod 34 abutting the back wall 123' of the recessed area 123 in the forward end of the double poppet valve 68, the offsetting forces of coil springs 88 and 130 cause the motor piston to suspend itself in an upstream closed position which is about midway between the extremities allowed by control rod 34, as seen in FIG. 1. In this position, check valves 102 and 120 and the slots 60 in the motor piston 68 are all closed, preventing any fluid flow through the valve assembly 10. The aforesaid force differential resulting from the larger effective area of the portion 118' of the sliding sleeve as compared to check valve 102 also tends to maintain the valve assembly 10 in the closed position, independent of any spring forces.

As coil spring 88 moves the motor piston upstream during closing of the valve assembly, a small amount of fluid passes through the small radial slot 44 in the radial sealing member 40 in valve head 36. This allows a limited flow about the sealing member 40 and through the motor piston 48 as it moves upstream, resulting in a relatively slow return of the motor piston to its upstream position, virtually eliminating any water hammering which frequently occurs when such valves are rapidly closed. In addition, slot 44 allows some continual flow back and forth through the motor piston 48. By allowing such continual movement of fluid through the motor piston, the motor piston can float back and forth on spring 88 in response to fluctuations in line pressure without periodically unloading the poppet seats and losing the reduced pressure zone. This limited fluid flow through the motor piston 48 cannot pass the first check valve 102 which remains closed until the entire valve assembly is opened by a reduction in downstream pressure, i.e., opening a downstream tap.

To maintain a substantial reduced fluid pressure in the reduced pressure zone 112 to prevent back flow siphoning when substantial fluctuations in line pressure are experienced, a port 136 is provided in the valve housing 12 which but for the air gap slider piston 66 would communicate with the reduced pressure zone 112. The downstream end of the air gap slider piston and "O" ring seal 86 effectively seal port 136. As noted earlier herein, the air gap slider piston 66 is movable between the stops 76 and 78 defined by the housing 12 and spanned by return spring 80. Should the fluid pressure head fall below about 40 psi when the valve 10 is in the closed position, the resulting pressure differential unbalances the air gap slider piston 66 and causes piston 66 to move to the left, opening port 136 and dumping any fluid in the reduced pressure zone 112 from the valve. The pressure within the reduced pressure zone immediately goes to atmospheric thereby maintaining a significant pressure break across the valve to prevent any siphoning from occurring. As soon as the line pressure rises, the air gap slider piston again moves downstream, closing port 136 but maintaining a substantially reduced fluid pressure in the reduced pressure zone.

Various changes and modifications may be made to the present invention without departing from the spirit and scope thereof. Insofar as these changes and modifications are within the purview of the appended claims, they are to be considered as part of the present invention.

I claim:

1. A pressure responsive valve assembly for use in a fluid flow line to prevent upstream flow therethrough, said assembly comprising a housing defining a fluid inlet and a fluid outlet, a control rod axially disposed within said housing, a piston carried by one end of said control rod, said piston being in sliding sealing engagement with said housing and inwardly spaced from said fluid inlet, means within said piston for allowing fluid flow therethrough in response to a decrease in fluid pressure at said fluid outlet, a first valve member slidably mounted on said control rod and defining an upstream valve means and a downstream valve means, a second valve member slidably mounted within said housing and cooperating with said upstream valve means to form a first check valve, means for urging said first check valve to a closed position, a third valve member slidably mounted within said housing on said control rod and cooperating with said downstream valve means to form a second check valve, means for urging said second check valve to a closed position, and a reduced pressure zone disposed about a portion of said first valve member between said first and second check valves, said zone being sealed from said fluid inlet and said fluid outlet when said check valves are in the closed position, whereupon the fluid pressure in said zone is substantially less than the fluid pressures at said fluid inlet and said fluid outlet.

2. The combination of claim 1 including means for evacuating fluid from said reduced pressure zone in response to a drop in fluid pressure at said fluid inlet.

3. The combination of claim 1 including a channel extending through said housing to said reduced pressure zone, means for urging said second valve member over said channel and sealing said channel from said reduced pressure zone, said second valve member being responsive to a decrease in pressure at said fluid inlet to move toward said inlet communicating said channel with said reduced pressure zone to allow fluid in said zone to pass through said channel thereby reducing the fluid pressure in said zone.

4. The combination of claims 1, 2 or 3 wherein said piston defines an interior chamber, a plurality of upstream slots communicating with said chamber and a plurality of downstream slots communicating with said chamber, and including a valve head affixed to said one end of said control rod, said valve head defining a radial sealing member disposed within said chamber in said piston, said piston being slidably mounted on said valve head such that upon being urged toward said fluid inlet, said radial sealing member on said valve head abuts said piston, sealing said downstream slots and preventing fluid flow therethrough.

5. The combination of claims 1, 2 or 3 wherein said first valve member defines an interior axial chamber therein about a portion of said control rod and at least one flow channel communicating said chamber with said reduced pressure zone and including a piston secured to said control rod within said chamber and spaced toward said fluid inlet from said flow channel to increase the effective area of said reduced pressure zone upon closure of said check valves and movement of said control rod toward said fluid inlet thereby reducing the fluid pressure within said reduced pressure zone with respect to the fluid pressures within said housing at said fluid inlet and said fluid outlet.

6. The combination of claims 1, 2 or 3 wherein said means for urging said first and second check valves to a closed position comprises a first biasing means disposed between said piston and said second valve member for urging said piston and said control rod toward said fluid inlet and said upstream valve means against said second valve member to close said first check valve and a second biasing means for urging said third valve member against said first valve member to close said second check valve.

7. A pressure responsive valve assembly for use in a fluid flow line to prevent upstream flow therethrough, said assembly comprising a housing defining a fluid inlet an a fluid outlet, a control rod axially disposed within said housing, a motor piston carried by one end of said control rod, said piston being in sliding sealing engagement with the portion of said housing and inwardly spaced from said fluid inlet, means within said piston for allowing fluid flow therethrough in response to a decrease in fluid pressure at said fluid outlet, an elongated double poppet valve slidably mounted within said housing on said control rod and defining an upstream sealing means, a downstream sealing means and an interior axial chamber disposed about a portion of said control rod, a piston secured to said control rod within said axial chamber and spaced toward said fluid inlet from said channel, an air gap slider piston slidably mounted within said housing about a portion of said double poppet valve and cooperating with said upstream sealing means on said double poppet valve to form a first check valve, a first biasing means disposed between said motor piston and said air gap slider piston for urging said motor piston toward said fluid inlet and said upstream sealing means against said air gap slider piston to close said first check valve, a slider sleeve slidably mounted within said housing on said control rod, a portion of said sleeve cooperating with said downstream sealing means on said double poppet valve to form a second check valve, a second biasing means for biasing said slider sleeve against said downstream sealing means to close said second check valve, a reduced pressure zone disposed about a portion of said double poppet valve between said first and second check valves and communicating with said axial chamber in said double poppet valve, said zone being sealed from said fluid inlet and said fluid outlet when said check valves are in the closed position whereupon the fluid pressure in said zone is substantially less than the fluid pressures at said fluid inlet and said fluid outlet, a channel extending through said housing to said reduced pressure zone for evacuating fluid in said reduced pressured zone, and means for urging said air gap slider piston over said channel.

8. The combination of claim 7 wherein said motor piston defines an interior chamber, a plurality of upstream slots communicating with said chamber and a plurality of downstream slots communicating with said chamber, and including a valve head affixed to said one end of said control rod, said valve head defining a radial sealing member disposed within said chamber in said motor piston, said motor piston being slidably mounted on said valve head such that upon said motor piston being urged toward said fluid inlet by said first biasing means, said radial sealing member on said valve head abuts said motor piston, sealing said downstream slots and preventing fluid flow therethrough.

9. The combination of claims 7 or 8 wherein the transverse area of said motor piston is sufficiently greater than the transverse area of said slider sleeve such that when fluid is flowing through said valve assembly the downstream hydraulic forces acting on said motor piston is greater than the upstream hydraulic forces acting on said slider sleeve and the force of said first biasing means thereby maintaining said valve assembly in the open position and said transverse area defined by said slider sleeve is greater than the transversed area defined by said double poppet valve across said first check valve whereby when said check valves are in the closed position the hydraulic forces within said valve assembly tend to maintain said check valves in the closed position until such time as fluid pressure at said fluid outlet is reduced.

10. The combination of claim 7 wherein said air gap slider piston is configured so as to be responsive to a decrease in upstream fluid pressure of about 40 psi whereupon said air gap piston moves off said channel, venting said reduced pressure zone to atmospheric pressure.

11. A pressure responsive valve assembly for use in a fluid flow line to prevent upstream flow therethrough, said assembly comprising a housing defining a fluid inlet and a fluid outlet, a control rod axially disposed within said housing, a piston carried by one end of said control rod, said piston being in sliding sealing engagement with said housing and inwardly spaced from said fluid inlet, means within said piston for allowing fluid flow therethrough in response to a decrease in fluid pressure at said fluid outlet, a first valve member slidably mounted on said control rod and defining an upstream valve means and a downstream valve means, a second valve member slidably mounted within said housing and cooperating with said upstream valve means to form a first check valve, a third valve member slidably mounted within said housing on said control rod and cooperating with said downstream valve means to form a second check valve, means for urging said first and second check valves to a closed position in response to an increase in fluid pressure at said fluid outlet and to an open position in response to a decrease in fluid pressure at said fluid outlet.

12. The combination of claim 11 wherein said means for urging said first and second check valves comprises biasing means for urging said upstream valve means against said second valve member to close said first check valve and a second biasing means for urging said third check valve member against said downstream valve means to close said first and second check valves in response to an increase in fluid pressure at said fluid outlet.

13. The combination of claim 12 wherein said third valve member defines a transverse area greater than the transverse area across said upstream valve member such that upon said check valves being closed in response to an increase in fluid pressure at said fluid outlet, hydraulic forces within said valve assembly maintain said check valves in the closed position and upon a decrease in fluid pressure at said fluid outlet, hydraulic forces urge said third valve member from said downstream valve means, opening said check valves and moving said piston toward said fluid outlet allowing fluid flow through said valve assembly.

14. The combination of claim 13 wherein the transverse area of said piston is sufficiently greater than said transverse area of said third valve member such that when fluid is flowing through said valve assembly the hydraulic forces acting on said piston is greater than the upstream hydraulic forces acting on said third valve member and the force of said biasing means for urging said upstream valve means against said second valve member.

15. A pressure responsive valve assembly for use in a fluid flow line to prevent upstream flow therethrough, said assembly comprising a housing defining a fluid inlet and a fluid outlet, a control rod axially disposed within said housing, a piston carried by one end of said control rod, said piston being in sliding sealing engagement with said housing and inwardly spaced from said fluid inlet, means within said piston for allowing fluid flow therethrough in response to a decrease in fluid pressure at said fluid outlet, a first valve member slidably mounted on said control rod and defining an upstream valve means and a downstream valve means, a second valve member slidably mounted within said housing and cooperating with said upstream valve means to form a first check valve, a first biasing means for urging said upstream valve means against said second valve member to close said first check valve, a third valve member slidably mounted within said housing on said control rod and cooperating with said downstream valve means to form a second check valve, a second biasing means for urging said third valve member against said downstream valve means to close said second check valve, said third valve member defining a transverse area greater than the transverse area across said upstream valve member, a reduced pressure zone disposed about a portion of said first valve member between said first and second check valves, said zone being sealed from said fluid inlet and said fluid outlet when said check valves are in the closed position, whereupon the fluid pressure in said zone is substantially less than the fluid pressure at said fluid inlet and said fluid outlet, an interior axial chamber disposed within said first valve member about a portion of said control rod, at least one flow channel communicating said chamber with said reduced pressure zone and a piston secured to said control rod within said chamber and spaced toward said fluid inlet from said flow channel to increase the effective area of said reduced pressure zone upon closure of said check valves and movement of said control rod toward said fluid inlet thereby reducing the fluid pressure within said reduced pressure zone with respect to the fluid pressures within said housing at said fluid inlet and said fluid outlet.

16. The combination of claims 11, 12 or 13 wherein said first valve member defines an interior axial chamber therein about a portion of said control rod and at least one flow channel communicating said chamber with said reduced pressure zone and including a piston secured to said control rod within said chamber and spaced toward said fluid inlet from said flow channel to increase the effective area of said reduced pressure zone upon closure of said check valves and movement of said control rod toward said fluid inlet thereby reducing the fluid pressure within said reduced pressure zone with respect to the fluid pressures within said housing at said fluid inlet and said fluid outlet.

* * * * *